US007721357B2

(12) United States Patent
Makabe et al.

(10) Patent No.: US 7,721,357 B2
(45) Date of Patent: May 25, 2010

(54) WEARABLE AIR BAG DEVICE

(75) Inventors: Takumi Makabe, Saitama (JP); Toshiya Nagatsuyu, Saitama (JP)

(73) Assignee: Honda Motor Co., Ltd., Tokyo (JP)

( * ) Notice: Subject to any disclaimer, the term of this patent is extended or adjusted under 35 U.S.C. 154(b) by 509 days.

(21) Appl. No.: 11/522,934

(22) Filed: Sep. 19, 2006

(65) Prior Publication Data

US 2007/0061941 A1 Mar. 22, 2007

(30) Foreign Application Priority Data

Sep. 21, 2005 (JP) ..... 2005-273880

(51) Int. Cl.
*G21F 3/02* (2006.01)

(52) U.S. Cl. ..... 2/456; 2/DIG. 3

(58) Field of Classification Search ..... 2/102, 2/455, 456, 463, 464, 465, 467, 411, 413, 2/462, DIG. 3; 411/88, 90, 92–94, 96
See application file for complete search history.

(56) References Cited

U.S. PATENT DOCUMENTS 4,059,852 A * 11/1977 Crane ..... 2/456
4,161,797 A * 7/1979 Ruscigno ..... 441/94
4,825,469 A * 5/1989 Kincheloe ..... 2/456
5,746,442 A * 5/1998 Hoyaukin ..... 280/730.1
6,125,478 A * 10/2000 Alaloof ..... 2/456
6,422,420 B1 * 7/2002 Brown ..... 222/5
6,766,535 B2 * 7/2004 Duhamell et al. ..... 2/102
6,848,644 B2 * 2/2005 Eberle et al. ..... 242/390.8
6,971,493 B2 * 12/2005 Yoshimoto ..... 188/312
7,380,291 B2 * 6/2008 Hashash ..... 2/456
7,401,364 B2 * 7/2008 Goto et al. ..... 2/102
7,516,980 B2 * 4/2009 Kobayashi et al. ..... 280/733

FOREIGN PATENT DOCUMENTS

JP 3048094 U 2/1998
JP 2002-020907 A 1/2002

* cited by examiner

*Primary Examiner*—Tejash Patel
(74) *Attorney, Agent, or Firm*—Birch, Stewart, Kolasch & Birch, LLP

(57) ABSTRACT

A wearable air bag device formed by defining air inflating chambers in a jacket of a rider of a vehicle. An ECU, a battery, a rider separation detecting part, a main switch and a warning device are incorporated into the jacket. A wire is connected to a vehicle via a connecting terminal. When a rider who wears the jacket is separated from the vehicle, the wire which is connected to the vehicle is extended and a reel is rotated. Upon detecting a rotational angular speed of the reel, the ECU determines that the rider is separated when the rotational angular speed is large. Upon detection of the separation of the rider, ECU develops an air bag by operating an inflator.

20 Claims, 4 Drawing Sheets

WEARABLE AIR BAG DEVICE

CROSS-REFERENCE TO RELATED APPLICATION

The present application claims priority under 35 U.S.C. §119 to Japanese Patent Application No. 2005-273880, filed Sep. 21, 2005, the entire contents of which are hereby incorporated by reference.

BACKGROUND OF THE INVENTION

1. Field of the Invention

The present invention relates to a wearable air bag device, and more particularly to a wearable air bag device which incorporates an air bag used as a buffer device for buffering an impact to a rider of a motorcycle or the like.

2. Description of Background Art

Conventionally, there has been proposed a body wear, that is, a jacket which incorporates an air inflating chamber (air bag) as a buffer for attenuating an impact to a rider of a motorcycle or the like. For example, Japanese Patent Laid-open 2002-20907 discloses a jacket provided with an air bag which is developed to cover the whole body of a rider. Further, Japanese Utility Model Registration Publication 3048094 discloses an automatically inflatable vest which includes two air chambers having volumes different from each other and makes these two air chambers act as buffers in two stages.

These conventional jackets adopt the structure in which the rider and a vehicle body are connected with each other by a wire, and when the rider moves away from the vehicle body and a distance between the rider and the vehicle body exceeds a predetermined value, the air bag is developed.

The jackets described in JP-A-2002-20907 and Japanese Utility Model Registration (Publication) No. 3048094 are configured such that the device is operated when the distance between the rider and the vehicle body is elongated larger than a predetermined quantity and hence, when the rider forgets to separate the wire in a usual get-off operation or when the rider erroneously manipulates the wire during the wire winding manipulation, the wire may be elongated exceeding the predetermined quantity thus operating the device.

Further, in the air bag device, it is necessary to provide parts other than a device body, for example, a control device which controls the air bag device body, a power source and the like. However, depending on the arrangement of these parts, there exists a possibility that the electric connection between the air bag device and the vehicle body becomes cumbersome.

Accordingly, there has been a demand for an air bag device which allows a rider to relatively freely handle an operating wire of the device and ensures the free movement of the rider by preventing an operation of the rider from being extremely restricted.

SUMMARY AND OBJECTS OF THE INVENTION

It is an object of the present invention to provide a wearable air bag device which can allow the rider to perform a connecting operation between the vehicle body and the rider easily and can reduce restrictions imparted to an operation of a rider of a motorcycle or the like.

According to a first aspect of the present invention, a wearable air bag device incorporates an air bag, an inflator which supplies a gas to the air bag and develops the air bag, a reel, a wire which is wound around the reel and a terminal which is provided to an end of the wire and is connected to a receiving jig which is connected to a vehicle side into a rider's wear. The terminal and the receiving jig on the vehicle side are constituted in a state that the connection therebetween is released by a tension of a predetermined value or more applied to the wire. In addition, the wearable air bag device further includes a sensor which detects a rotational angular speed of the reel, a control device which outputs a command which operates the inflator when the rotational angular speed detected by the sensor exceeds a predetermined value, and a power source for the control device.

According to a second aspect of the present invention, the wearable air bag device further includes a main switch which supplies electricity to the control device.

According to a third aspect of the present invention, the sensor and the control device are mounted on a common substrate.

According to a fourth aspect of the present invention, the wearable air bag device includes a means which detects the connection/separation of the terminal and the receiving jig.

According to the first aspect of the present invention, since the whole air bag device is incorporated into a rider's wear, an electrical connection portion or the like of the air bag device with a vehicle side becomes unnecessary thus eliminating the cumbersomeness. Further, since the necessity of an operation of the air bag device is determined based on a rotational angular speed of the reel, different from the determination based on a pulling quantity of the wire, there is no possibility that the air bag device is operated erroneously during handling the vehicle or due to a motion of a rider.

According to the second aspect of the present invention, the main switch is operated at a position closest to a rider and hence, an operability of the switch can be enhanced.

According to the third aspect of the present invention, with the provision of the common substrate, it is possible to easily incorporate the wearable air bag device into the rider's wear.

According to the fourth aspect of the present invention, for example, even when the rider forgets to release the connection between the terminal and the receiving jig and gets off the vehicle, it is possible to easily supply a detection signal to the warning device.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus are not limitative of the present invention, and wherein.

DETAILED DESCRIPTION OF THE PREFERRED EMBODIMENTS

Figure 1:
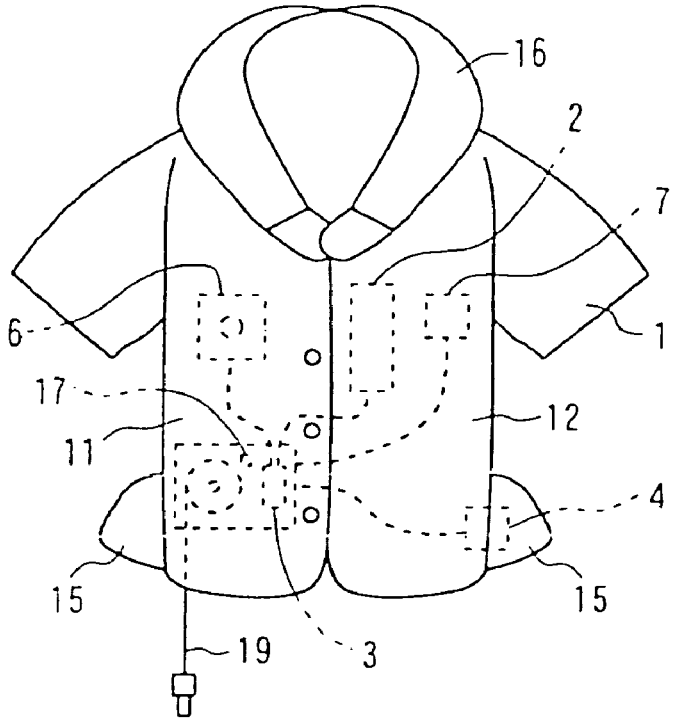
FIG. 1 is a front view of a jacket according to one embodiment of the invention.
Figure 2:
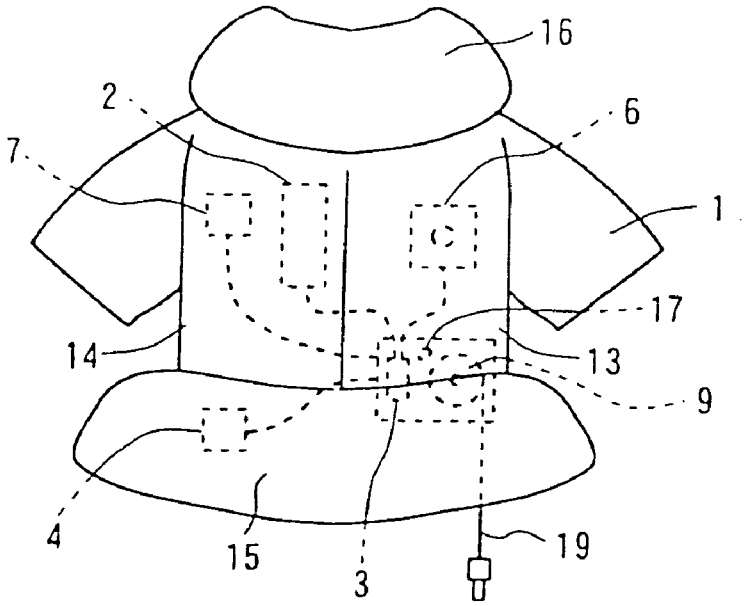
FIG. 2 is a back view of a jacket according to one embodiment of the invention.
Figure 3:
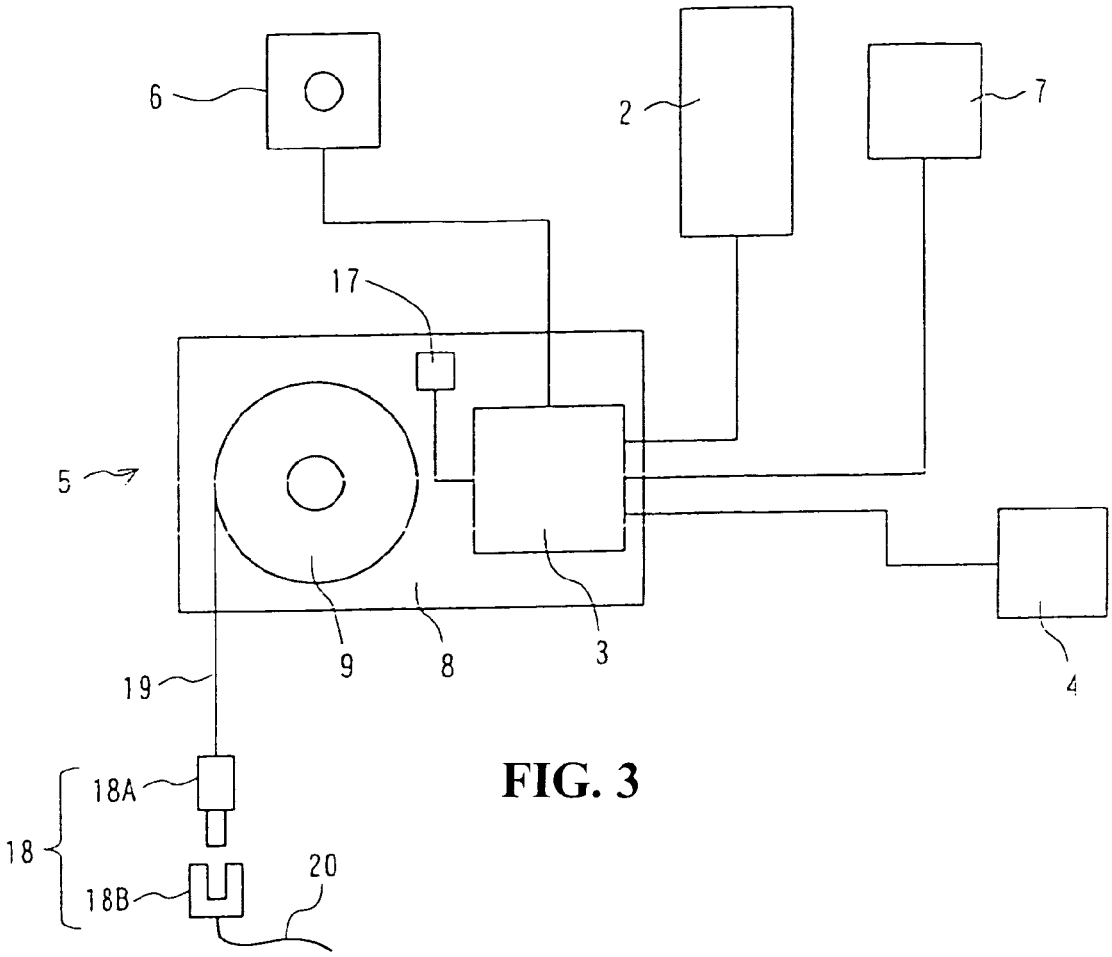
FIG. 3 is a constitutional view of an air bag device body which is separated jacket.
Figure 4:
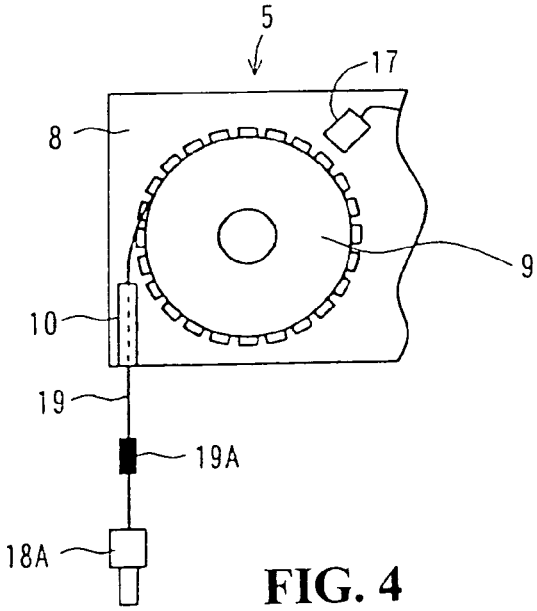
FIG. 4 is an enlarged view of a rider separation detecting part.

FIG. 1 is a front view of a jacket which constitutes a rider-use air bag device of a motorcycle according to one embodiment of the present invention, and FIG. 2 is a back view of the jacket, wherein both of these drawings are views in a state that the air bag is not developed. FIG. 3 is a view showing the air bag device which is separated from the jacket. FIG. 4 is an enlarged view of a rider separation detecting portion.

The jacket 1 includes an air inflating chamber which is divided into a right from portion 11, a left front portion 12, a right rear portion 13, a left rear portion 14, a waist portion 15 and a collar portion 16. These air inflating chambers are connected to an inflator 2 which supplies a gas for inflation. The inflator 2 which supplies the gas to the respective air inflating chambers when the air bag device is operated, an ECU 3 which controls the inflator 2, a battery 4 for the ECU 3, a sensor device, that is, a so-called rider separation detecting part 5 which detects a change of a distance between the rider and a vehicle body of the motorcycle, and a main switch 6 are mounted on the jacket 1. A warning device 7 which indicates troubles of the respective parts mounted on the jacket 1 or an abnormal operation of the rider is mounted on the jacket 1. Here, the warning device 7 is a buzzer or a vibrator. It may be possible to fix the respective parts and the warning device 7 by stitching them in the jacket 1 or by respectively accommodating them in a pocket-shaped accommodating portion. The inflator 2 is constituted of a carbon dioxide container and a starting device which breaks the sealing of the carbon dioxide container.

The rider separation detecting part 5 is mounted on a substrate 8 on which the ECU 3 is mounted. The substrate 8 may preferably be a flexible substrate. Essential parts of the rider separation detecting part 5 are constituted of a reel 9, a wire 19 and a sensor 17 which are mounted on the substrate 8. The reel 9 is rotatably supported on the substrate 8, and the sensor 17 is arranged in a state that the sensor 17 faces an outer periphery of the reel 9 for detecting a rotational quantity of the reel 9.

The wire 19 is wrapped around the reel 9 in a state that one end of the wire 19 is fixed to the reel 9, and another end of the wire 19 is connected to a connecting terminal 18 which is used for connection with the vehicle body. The reel 9 is biased to be rotated in one direction by a coil spring or the like such that the wire 19 is wound around the reel 9 when the end portion of the wire 19 is in a free state. A tubular guide 10 which guides the wire 19 to an outer periphery of the reel 9 is mounted on the flexible substrate 8. A plurality of projecting portions and recessed portions is formed on the outer periphery of the reel 9 at a fixed interval, wherein the sensor 17 detects the projecting portions or recessed portions, and the ECU 3 calculates the rotational angular speed of the reel 9 based on detection signals (pulse signals) of the projecting portions and recessed portions detected by the sensor 17. When a magnetism-electricity converting element is adopted as the sensor 17, at least an outer periphery of the reel 9 may preferably be formed of metal. Here, the sensor 17 may be a resistor element such as a potentiometer or the like which is mounted on a rotary shaft of the reel 9 and can detect the rotational angle of the rotary shaft.

The reel 9 includes a stopper, wherein when the reel 9 is rotated by a predetermined angle, the further rotation of the reel 9 is restricted by the stopper. The stopper may be constituted of a pin which is mounted on a flexible substrate 8 side and a member which is arranged to come into contact with the pin and projects from the reel 9 side. On the other hand, as shown in FIG. 4, the stopper may be constituted such that a large-diameter portion 19A is formed on the wire 19 and the rotation of the reel 9 is stopped at a position where the large-diameter portion 19A comes into contact with an end portion of the tubular guide 10.

The connecting terminal 18 is constituted of a plug 18A which is connected to the wire 19 and a receiving jig, that is, a socket 18B which is connected to a wire 20 which has one end thereof connected to a vehicle body frame (a member which mounts a seat on an upper portion thereof) not shown in the drawing. These plug 18A and socket 18B are connected with each other by elasticity of an elastic member such as a spring or the like, and when the plug 18A and the socket 18B are pulled with a force larger than the elasticity, the plug 18A and the socket 18B are separated from each other. For example, a banana plug which is generally used as an audio part may be used as the plug 18A.

Figure 5:
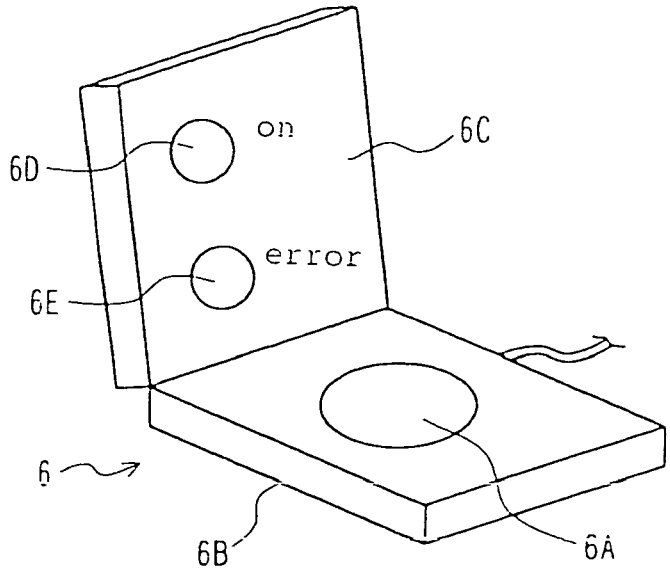
FIG. 5 is an enlarged perspective view of a main switch.

One example of the main switch 6 is shown in FIG. 5. The main switch 6 includes a body side 6B on which a push button 6A is mounted and a foldable lid 6C which prevents the push button 6A on the body side 6B from being manipulated erroneously. Here, the lid 6C may include an indicator which is constituted of a lamp 6D which is turned on when the switch 6 is turned on and a lamp 6E which performs an error indication.

Figure 6:
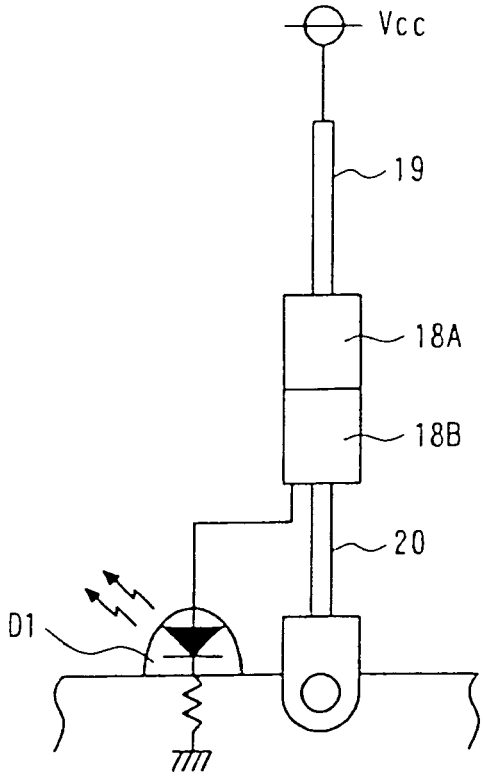
FIG. 6 is a view showing a connection state detection device of a connecting terminal.

Further, means which detects a connecting state of the connecting terminal 18 and an indicator which indicates the connecting state of the connecting terminal 18 may be provided to the vehicle body side. For example, as shown in FIG. 6, the ECU 3 is configured to supply a reference voltage Vcc to the wire 19 or the plug 18A. When the main switch 6 is turned on, an anode of a light emitting diode D1 which has a cathode thereof grounded is connected to the vehicle-body-side socket 18B or the wire 20. When the plug 18A and the socket 18B of the connecting terminal 18 are connected with each other, due to the reference voltage Vcc, an electric current flows in the light emitting diode D1 which constitutes the indicator mounted on the vehicle body side and hence, the light emitting diode D1 emits light. Here, when a connection failure occurs in the connecting terminal 18 or the plug 18A and the socket 18B are separated from each other, the light emitting diode D1 does not emit light.

Figure 7:
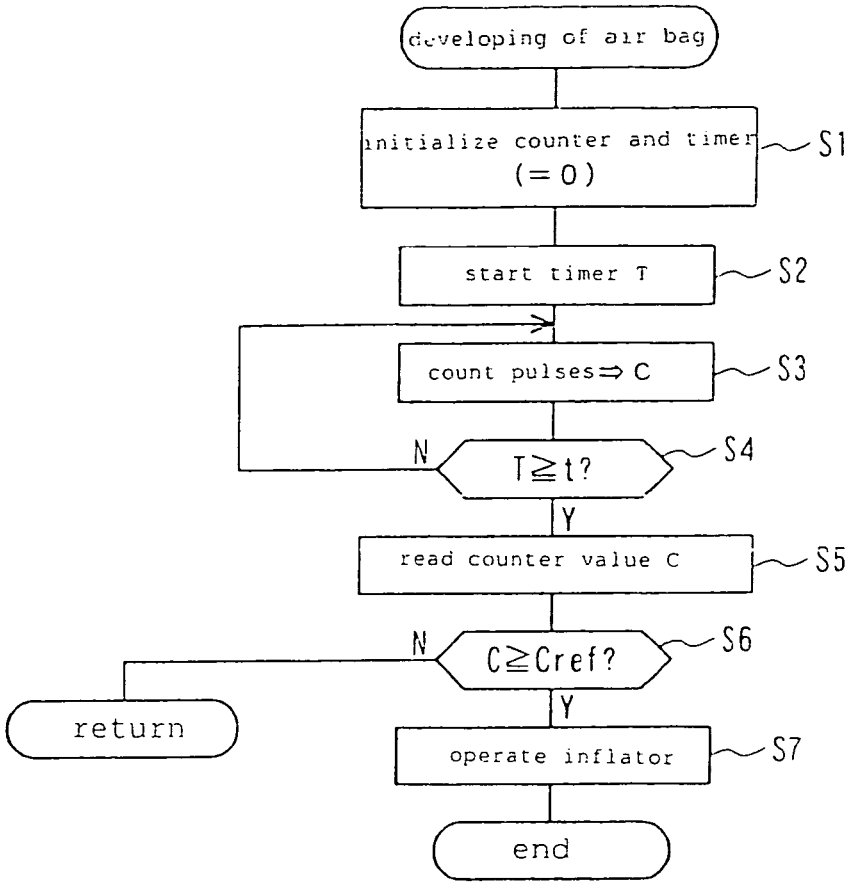
FIG. 7 is a flowchart of air bag developing processing.

FIG. 7 is a flowchart showing an essential processing of the ECU 3 which is mounted on the jacket 1.

In this processing, the rotational angle of the reel 9 during a predetermined time is detected. When the detected rotational angle is larger than a predetermined value, the air bag is developed by operating the inflator. In step S1, a counter C and a timer T are initialized (to zero). In step S2, the timer T is started. In step S3, pulse signals which are generated in response to the projection portions and the recessed portions formed on the outer periphery of the reel 9 are read by the sensor 17, and the counter C is updated. In step S4, the ECU 3 determines whether the predetermined time t has lapsed or not. When the timer T assumes a value indicative of a time t, the processing advances to step S5 and the ECU 3 reads a value of the counter C. In step S6, the ECU 3 determines whether the value of the counter C is larger than a predetermined value Cref or not, and when the determination in step S6 is affirmative, the processing advances to step S7 and the inflator is operated.

Figure 8:
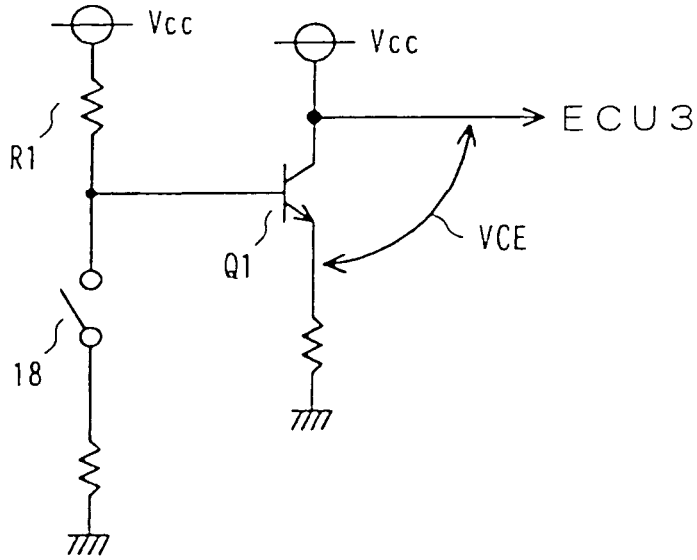
FIG. 8 is a view showing a connection state detecting circuit of the connecting terminal.

When an abnormal operation of the rider is detected by detecting a connection state of the connecting terminal 18, the warning device 7 on the jacket 1 side may also be operated. FIG. 8 is a detection circuit which is provided to the jacket 1 side for detecting the connection of the connecting terminal 18.

In FIG. 8, the connecting terminal 18 is configured to include an electric contact. A power source Vdd from the battery 4 is connected to the connecting terminal 18, and the power source Vcc is also connected to a base of a transistor Q1 via a resistance R1. A collector voltage VCE of the transistor Q1 is inputted to the ECU 3. In such a constitution, when the connecting terminal 18 is connected, the collector voltage VCE of the transistor Q1 assumes a low (L) potential, while when the connecting terminal 18 is separated, the collector voltage VCE assumes a high (H) potential. The ECU 3 may detect the connection state of the connecting terminal 18 based on this potential.

As one function of the warning device 7, the warning device 7 may also have a function which gives a warning when the rider stops the vehicle and, thereafter, intends to leave from the vehicle without releasing the connection of the connecting terminal 18 to the vehicle. For example, the ECU 3 determines the connection state of the connecting terminal 18 when a predetermined time lapses after the rider turns off the switch 6. When the voltage between the base and the collector of the transistor Q1 assumes an L potential, the ECU 3 determines that the connecting terminal 18 is not released and operates the warning device 7.

Further, the same warning may be performed as follows. The reel 9 is biased to be rotated in one direction and hence, when the connecting terminal 18 is separated from the vehicle, the wire 19 is wound around the reel 9 until the stopper is operated. Accordingly, in such a state, the reel 9 is not rotated. However, when the rider intends to leave the vehicle without releasing the connecting terminal 18, the wire 19 is pulled and the reel 9 is rotated and hence, the ECU 3 detects the pulse signals generated from the sensor 17. Accordingly, when the pulse signals are detected in spite of the fact that the main switch 6 is turned off, the ECU 3 determines that the rider intends to leave the vehicle while leaving the connecting terminal 18 in the connection state and operates the warning device 7. The warning device 7 may use vibrations, electronic sounds or both of them.

Here, the above-mentioned warning may be performed when the rider turns off the main switch 6 and intends to get off the vehicle. Accordingly, to ensure the power source for the ECU 3, the ECU 3 is configured such that even when the main switch 6 is turned off, the supply of the electricity from a battery is stopped after the predetermined time lapses.

Further, even when the connecting terminal 18 is separated and the rider intends to get off the vehicle while holding the main switch 6 in an ON state, the ECU 3 may operate the warning device 7.

In this embodiment, the case in which the air bag device is incorporated into the jacket, that is, an upper wear is exemplified. However, the present invention is not limited to such an example and the air bag device may be incorporated into wear which is suitable for a ride on the motorcycle such as a vest, overalls or the like.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A wearable air bag device comprising:

an air bag, an inflator which supplies a gas to the air bag and develops the air bag, a reel which is incorporated into the wearable air bag device, a wire which is wound around the reel, and a terminal which is provided to an end of the wire, the terminal being connectable to a vehicle side via a receiving jig which is attached to the vehicle side, wherein the terminal and the receiving jig on the vehicle side are connectable to each other such that the connection therebetween is released by a tension of a predetermined value applied to the wire, and the wearable air bag device further including:

a sensor which detects a rotational angular speed of the reel;

a control device which outputs a command which operates the inflator when the rotational angular speed detected by the sensor exceeds a predetermined value, and a power source for the control device.

2. The wearable air bag device according to claim 1, further comprising a main switch which supplies electricity to the control device.

3. The wearable air bag device according to claim 1, wherein the reel, the sensor and the control device are mounted on a common substrate.

4. The wearable air bag device according to claim 2, wherein the reel, the sensor and the control device are mounted on a common substrate.

5. The wearable air bag device according to claim 1, further comprising:

connection/separation detection means which detects the connection/separation of the terminal and the receiving jig.

6. The wearable air bag device according to claim 2, further comprising:

connection/separation detection means which detects the connection/separation of the terminal and the receiving jig.

7. The wearable air bag device according to claim 3, further comprising:

connection/separation detection means which detects the connection/separation of the terminal and the receiving jig.

8. The wearable air bag device according to claim 2, wherein the main switch includes a body side on which a push button is mounted;

a foldable lid which prevents the push button on the body side from being manipulated erroneously; and a lid including an ON/OFF indicator lamp which is turned on when the switch is turned on and a error indication lamp which performs an error indication.

9. The wearable air bag device according to claim 5, wherein the connection/separation detection means includes a light emitting diode mounted on the vehicle side, the light emitting diode emitting light when the terminal and the receiving jig are connected with each other.

10. The wearable air bag device according to claim 1, further comprising a warning device mounted on the air bag device, and in the case where the rider has not released the connection between the terminal and the receiving jig, the warning device gives off a warning signal at a predetermined to time after the main switch has been turned off.

11. A wearable air bag device comprising:

an air bag, an inflator which supplies a gas to the air bag and develops the air bag, a reel which is incorporated into the wearable air bag device, a wire which is wound around the reel, and a terminal which is provided to an end of the wire, the terminal being connectable to a vehicle side via a receiving jig which is attached to the vehicle side, wherein the terminal and the receiving jig on the vehicle side are connectable to each other such that the connection therebetween is released by a tension of a predetermined value applied to the wire, and the wearable air bag device further including:

a sensor which detects a rotational angular speed of the reel;

a control device which outputs a command which operates the inflator when the rotational angular speed detected by the sensor exceeds a predetermined value, and a battery for the control device.

12. The wearable air bag device according to claim 11, further comprising a main switch which supplies electricity to the control device.

13. The wearable air bag device according to claim 11, wherein the reel, the sensor and the control device are mounted on a common substrate, the substrate being flexible.

14. The wearable air bag device according to claim 12, the wearable air bag device being a jacket for a rider of a two wheeled vehicle.

15. The wearable air bag device according to claim 11, further comprising:

connection/separation detection means which detects the connection/separation of the terminal and the receiving jig.

16. The wearable air bag device according to claim 12, further comprising:

connection/separation detection means which detects the connection/separation of the terminal and the receiving jig.

17. The wearable air bag device according to claim 11, wherein the inflator, the battery, the sensor, and the control device are fitted into pockets of the wearable air bag device.

18. The wearable air bag device according to claim 12, wherein the main switch includes a body side on which a push button is mounted;

a foldable lid which prevents the push button on the body side from being manipulated erroneously; and a lid including an ON/OFF indicator lamp which is turned on when the switch is turned on and a error indication lamp which performs an error indication.

19. The wearable air bag device according to claim 15, wherein the connection/separation detection means includes a light emitting diode mounted on the vehicle side, the light emitting diode emitting light when the terminal and the receiving jig are connected with each other.

20. The wearable air bag device according to claim 11, further comprising a warning device mounted on the air bag device, and in the case where the rider has not released the connection between the terminal and the receiving jig, the warning device gives off a warning signal at a predetermined to time after the main switch has been turned off.

* * * * *